US006769479B2

(12) United States Patent
Fitzpatrick et al.

(10) Patent No.: US 6,769,479 B2
(45) Date of Patent: Aug. 3, 2004

(54) PRIMARY SURFACE RECUPERATOR SHEET

(75) Inventors: Michael D. Fitzpatrick, San Diego, CA (US); John P. Montague, San Marcos, CA (US)

(73) Assignee: Solar Turbines Inc, San Diego, CA (US)

( * ) Notice: Subject to any disclaimer, the term of this patent is extended or adjusted under 35 U.S.C. 154(b) by 0 days.

(21) Appl. No.: 10/166,992

(22) Filed: Jun. 11, 2002

(65) Prior Publication Data

US 2003/0226655 A1 Dec. 11, 2003

(51) Int. Cl.[7] ..... F28F 3/00; F28F 7/00; F28D 19/00

(52) U.S. Cl. ..... 165/166; 165/82; 165/81; 165/10

(58) Field of Search ..... 165/166, 167, 165/81, 905, DIG. 356, 10, 82

(56) References Cited

U.S. PATENT DOCUMENTS 3,759,323 A * 9/1973 Dawson et al. ..... 165/166
3,880,232 A * 4/1975 Parker ..... 165/166
4,049,051 A * 9/1977 Parker ..... 165/166
4,338,998 A * 7/1982 Goloff ..... 165/165
4,346,760 A * 8/1982 Vidal-Meza ..... 165/166
5,060,721 A 10/1991 Darragh
5,555,933 A * 9/1996 Darragh et al. ..... 165/166
5,584,341 A * 12/1996 Sabin et al. ..... 165/166
5,983,992 A * 11/1999 Child et al. ..... 165/81

* cited by examiner

*Primary Examiner*—Henry Bennett
*Assistant Examiner*—Tho Duong
(74) *Attorney, Agent, or Firm*—Larry G Cain

(57) ABSTRACT

A primary surface recuperator is made from a plurality of components, one of such components being a primary surface sheets. The primary surface sheet is used to transfers heat from a donor fluid to a recipient fluid. A first sheet portion of the primary surface sheet has a pair of sides and has a preestablished thermal deformation characteristic including a resistance to high temperature deformation and a high temperature resistance to corrosion. A second sheet portion has a pair of sides and has a preestablished thermal deformation characteristic being less than the resistance to high temperature deformation and the high temperature resistance to corrosion of the first sheet portion. The first sheet and the second sheet are attached at a respective one of the pair of sides of the first sheet portion and the second sheet portion forming an axis. The axis is positioned at an angle to the pair of sides.

13 Claims, 4 Drawing Sheets

PRIMARY SURFACE RECUPERATOR SHEET

TECHNICAL FIELD

This invention relates generally to a heat exchanger or a recuperator and more particularly to a heat conducting sheet used in making the heat exchanger or the recuperator.

BACKGROUND

Many gas turbine engines use a heat exchanger or recuperator to increase the operation efficiency of the engine by extracting heat from the exhaust gas and preheating the intake air. Typically, a recuperator for a gas turbine engine must be capable of operating at a temperature of between about 500 degrees C. and 800 degrees C. and internal pressures of between approximately 450 kPa and 1400 kPa under operating conditions involving repeated starting and stopping cycles. The exhaust gas normally determines the operating temperature and the intake air after being compressed normally determines the internal pressure.

Many recuperators are of a primary surface construction. In a primary surface recuperator, a plurality of sheets are stacked in a spaced apart configuration to form a cell. The spacing therebetween form a plurality of donor passages and a plurality of recipient passages. In many operations, the hot exhaust gas, between 500 degrees C. and 800 degrees C., is passed through the donor passages and an atmospheric temperature intake air is passed through the recipient passages. Although the atmospheric intake air may have passed through the compressor of the gas turbine engine, the temperature of the intake air is substantially below the 500 degrees C. to 800 degrees C. of the exhaust gas. Therefore, heat from the hot exhaust is transferred through the sheet and absorbed by the cooler intake air. Thus, thermal energy from the exhaust gas is extracted and conducted to the intake air increasing the efficiency of the engine.

In many applications the primary surface sheet used in forming the cell is very thin, flimsy and difficult to maintain a uniform cross sectional area of the passages between sheets. To enhance the rigidity of the thin sheets, the sheets are formed into an accordion type configuration forming peaks or crests and valleys. The peaks or crests and valleys form a plurality of upwardly and downwardly opening, transversely extending, relatively deep grooves being relatively closely spaced and having substantially vertical side walls or fins. In forming a recuperator using such sheets, the peeks of alternate sheets are aligned and the valleys of alternate sheets are aligned to form the donor passages and the recipient passages. Additionally, many of the sheets are formed with a serpentined configuration to enhance a controlled turbulent which increases heat conductivity and resulting efficiency. In manufacturing such recuperators, the component parts are fixedly attached together, usually by a welding process, to prevent leakage from the respective donor passages and recipient passages.

U.S. Pat. No. 5,060,721 issued on Oct. 29, 1991 to Charles T. Darragh discloses an example of one such recuperator. The recuperator disclosed in this patent has a circular configuration. The recuperator has a plurality of cell made from a pair of primary surface sheets, a plurality of spacer bars and a plurality of guide strips. The component parts are welded together to form the recuperator. The welding of these thin sheet and component parts into a cell having a sealed interface is difficult to accomplish in a cost effective and efficient manner.

During the operation of the gas turbine engine hot exhaust gas enters a portion of the recuperator, inlet of the donor passage, and cool atmospheric air enters another portion of the recuperator, the inlet of the recipient passage. The thermal stress placed on the components making up the cell and the recuperator causes the welds and components to fail after a number of cycles. To increase the number of cycles before failure, the materials, welds, assembly and assembly techniques need to be reviewed to overcome the thermal stress. For example, the hot donor fluid, exhaust gas, is at a temperatures of between about 500 degrees C. and 800 degrees C. and the recipient fluid, atmospheric intake air, is at or near an atmospheric temperatures of between about 0 degrees C. and 60 degrees C. Thus, the thermal difference or gradients experienced by the recuperator is extremely high. Thus, the thermal stress induced is also extremely high. Thus, a more effective and efficient use of materials and processes is needed to insure the increased longevity of the heat exchanger or recuperator.

The present invention is directed to overcome one or more of the problems as set forth above.

SUMMARY OF THE INVENTION

In one aspect of the invention, a primary surface sheet is adapted for use in a recuperator. The primary surface sheet has a first portion having a preestablished thermal deformation characteristic, the preestablished thermal deformation characteristic includes a resistance to high temperature deformation and a high temperature resistance to corrosion and a second sheet portion having a preestablished thermal deformation characteristic being less than the resistance to high temperature deformation and the high temperature resistance to corrosion than that of the first sheet portion are attached to form the primary surface sheet.

In another aspect of the invention, a cell is adapted for use with a recuperator. The cell has a plurality of primary surface sheets spaced apart a preestablished distance forming a fluid flow path. Each of the primary surface sheets have a first portion having a preestablished thermal deformation characteristic, the preestablished thermal deformation characteristic includes a resistance to high temperature deformation and a high temperature resistance to corrosion and a second sheet portion having a preestablished thermal deformation characteristic being less than the resistance to high temperature deformation and the high temperature resistance to corrosion than that of the first sheet portion. The first portion and the second portion are attached to form the primary surface sheet. A plurality of bars are interposed the plurality of primary surface sheets and the plurality of primary surface sheets and the plurality of bars are fixedly attached.

In another aspect of the invention, a method of making a recuperator is disclosed. The recuperator is made from a plurality of cell which are made from a plurality of component parts. The method of making the recuperator includes forming a primary surface sheet by attaching a first portion to a second portion, the first portion having a preestablished thermal deformation characteristic, the preestablished thermal deformation characteristic has a resistance to high temperature deformation and a high temperature resistance to corrosion and the second sheet portion having a preestablished thermal deformation characteristic being less than the resistance to high temperature deformation and the high temperature resistance to corrosion than that of the first sheet portion. The cell is formed by spacing a pair of the primary surface sheets apart a preestablished distance forming a fluid flow path and positioning a plurality of bars between the pair of the primary surface sheets. And, the pair of primary surface sheets are attached with the plurality of bars.

In another aspect of the invention, a method of making a primary surface sheet is adapted for use with a recuperator. The method of making the primary surface sheet includes attaching a first portion of the primary surface sheet to a second portion of the primary surface sheet. The first portion has a preestablished thermal deformation characteristic, the preestablished thermal deformation characteristic has a resistance to high temperature deformation and a high temperature resistance to corrosion and the second sheet portion has a preestablished thermal deformation characteristic being less than the resistance to high temperature deformation and the high temperature resistance to corrosion than that of the first sheet portion.

DETAILED DESCRIPTION

Figure 1:
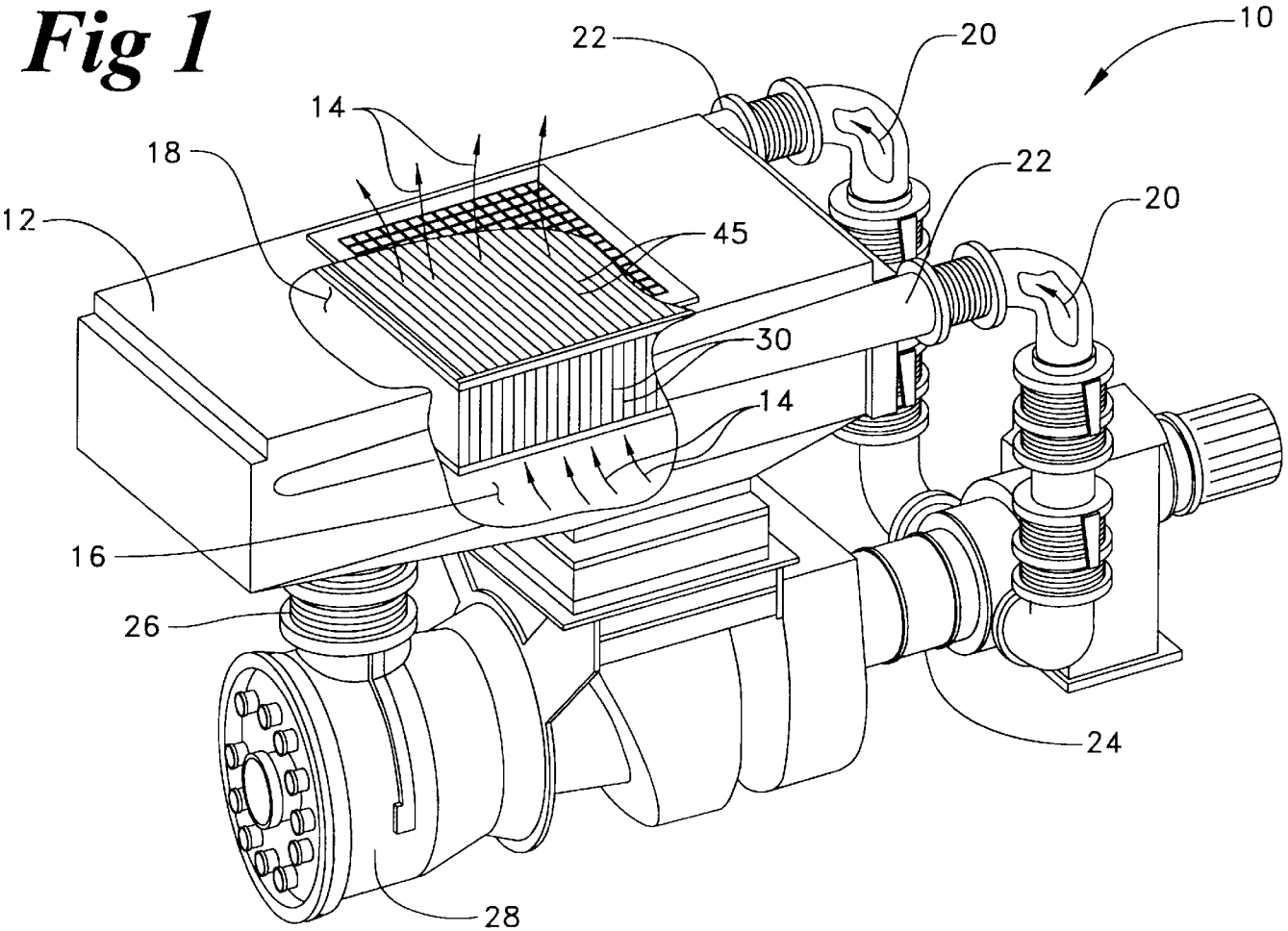
FIG. 1 is a view of a gas turbine engine having a partially sectioned recuperator.

Referring to FIG. 1, a gas turbine engine 10 has a recuperator 12 operatively attached thereto. The gas turbine engine 10 has a flow of exhaust gas or donor fluid, designated by an arrow 14, entering the recuperator 12 through a donor inlet duct 16 and exiting through a donor outlet duct 18. The recuperator 12 has a flow of atmospheric air or recipient fluid, designated by an arrow 20, entering through a recipient inlet duct 22 from a compressor section 24 of the gas turbine engine 10 and exiting through a recipient outlet duct 26 to a combustor section 28 of the gas turbine 10.

Figure 2:
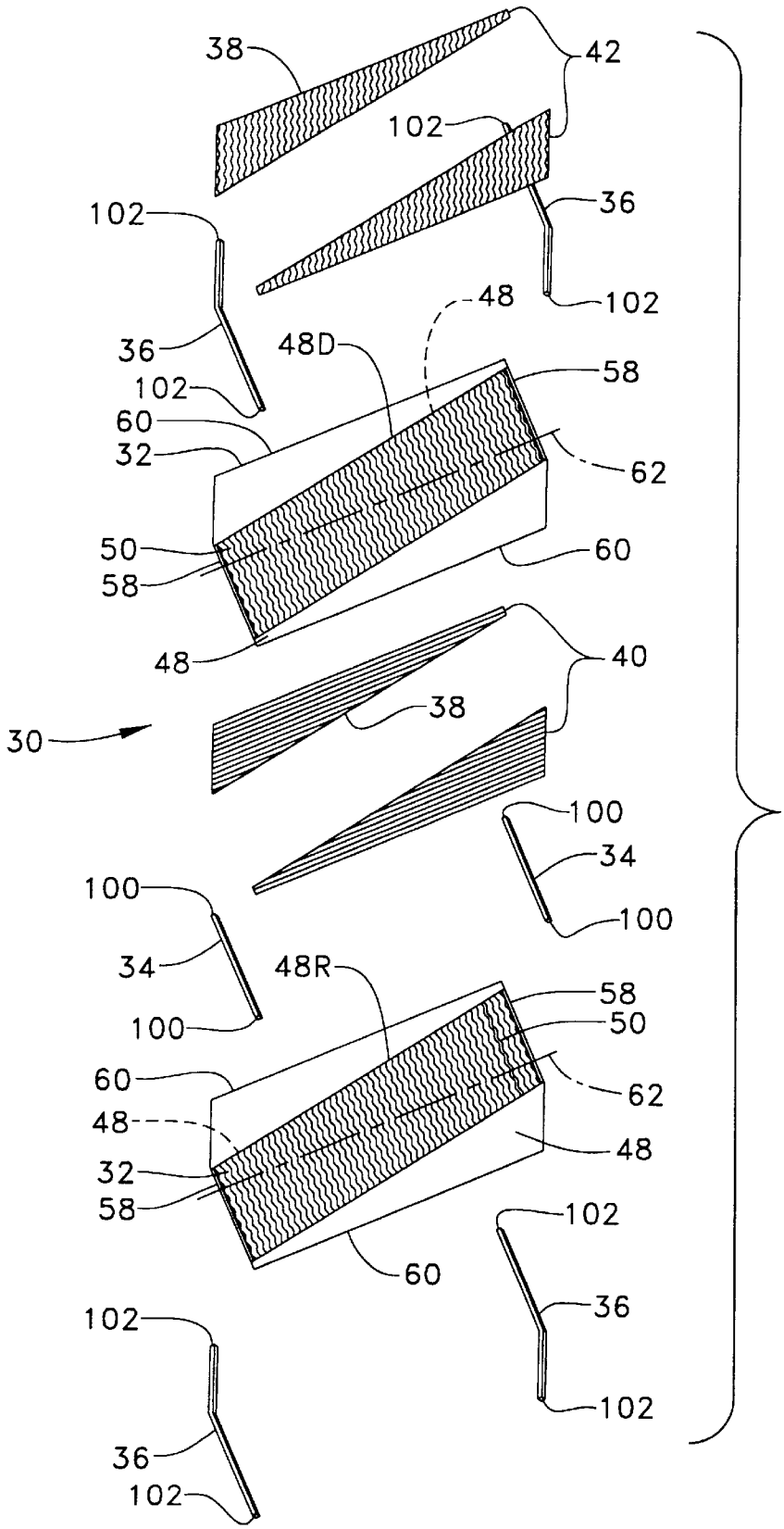
FIG. 2 is an exploded view of a cell used in manufacturing a recuperator.
Figure 4:
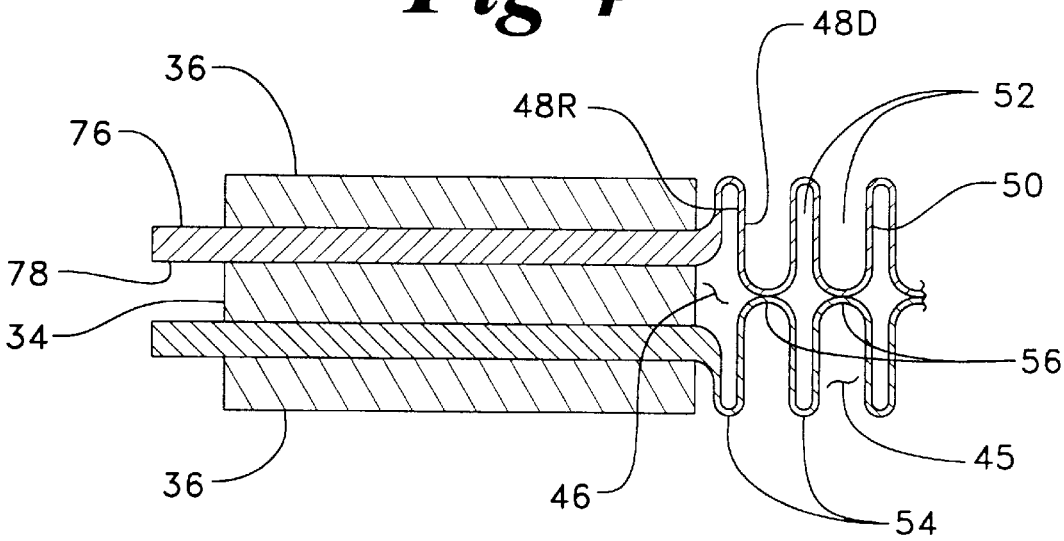
FIG. 4 is a sectional view taken along line 4—4 of FIG. 3.

In this application, the recuperator 12 is made from a plurality of cells 30 as are further shown in FIG. 2. Each of the plurality of cells 30 is made up of a plurality of components such as a pair of sheets 32, a plurality of recipient bars 34, a plurality of donor bars 36 and a plurality of guiding members 38. The guiding members are divided into a pair of recipient guide members 40 and a pair of donor guide members 42. The plurality of components are attached to form individual ones of the plurality of cells 30. And, the plurality of cells 30 are attached to form a core 44 of the recuperator 12. Positioned within the core 44 is a plurality of donor passages 45 and a plurality of recipient passages 46, best shown in FIG. 4.

Figure 3:
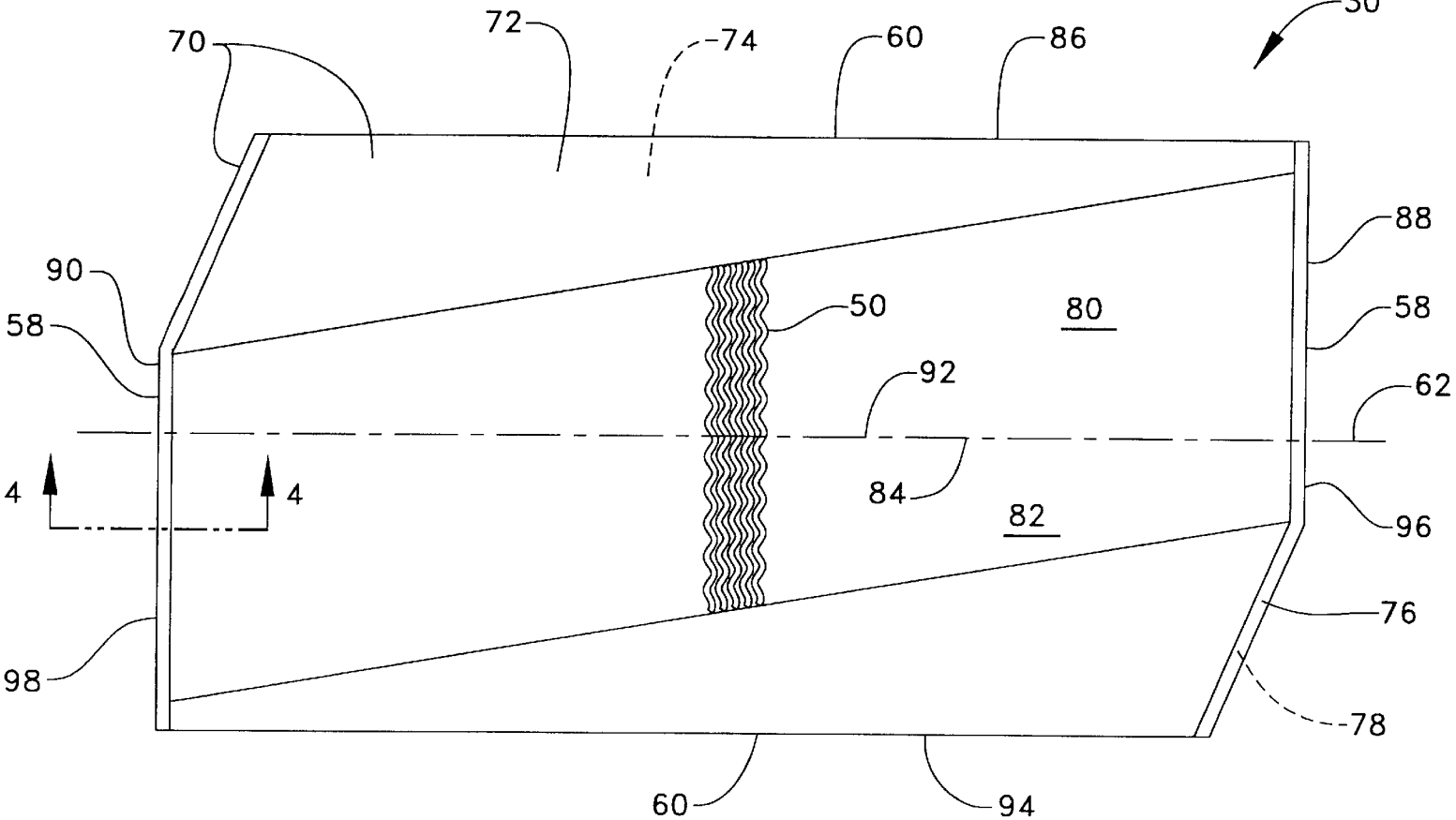
FIG. 3 is an elevational view of a primary surface recuperator sheet having a plurality of spacer bars attached thereto.

In this application, each of the pair of sheets 32 is made from rolled stock, not shown, and each of the pair of sheets is used as a primary surface sheet 32 for the recuperator 12 which is a primary surface heat exchanger 12. As an alternative, each of the pair of sheets 32 can be made from a fixed size sheet stock verses the rolled stock. Each of the pair of sheets 32 has a pair of sides 48, one being a donor side 48D and another being a recipient side 48R, between which is defined a preestablished thickness being very thin, about 2.3 mm. Each of the pair of sheets 32 has a preestablished width. The thickness, width and a length of the sheet can be varied without changing the gest of the invention. As is further shown in FIGS. 3 and 4, each of the pair of sheets 32 is folded to form a plurality of serpentined pleats 50. The plurality of serpentined pleats 50 form a fluid flow path 52 interposed respective ones of the plurality of serpentined pleats 50. The plurality of serpentined pleats 50 form a plurality of roots 54 and a plurality of crests 56, best shown in FIG. 4. Each of the primary surface sheets 32 is formed to a shape, which in this application has a pair of ends 58 and a pair of sides 60. Extending between the pair of sides 60 and generally perpendicular with the fluid flow path 52, if the pleats 50 were not serpentined, is an axis 62. In this application, the axis 62 is equally spaced between the pair of sides 60. However, as an alternative, the axis 62 could be placer at any predetermined distance from the pair of sides 60 and could be position at an angle to the pair of sides 60 or the fluid flow path, if desired, without changing the gest of the invention. In this application, the plurality of serpentined pleats 50 on each of the primary surface sheets 32 is stamped, but as an alternative could be rolled. Each of the plurality of primary surface sheets 32 has a plurality of flattened surfaces 70. In this application, each of the plurality of flattened portions 70 on each of the primary surface sheets 32 is stamped, but as an alternative could be rolled or as a further alternative use a separate sheet being attached to the plurality of serpentined pleats 50. Positioned along each of the pair of sides 60 is a donor side flattened surface 72 and a recipient side flattened surface 74. The plurality of flattened portions 70 also extend from each of the pair of end 48 a preestablished distance and form a donor end flattened surface 76 and a recipient end flattened surface 78. In this application, each of the donor side flattened surface 72 and the recipient side flattened surface 74 has a generally triangular configuration. When looking at a cross-section of each of the primary surface sheets 32 the plurality of roots 54 and the plurality of crests 56 extend beyond, above and below, the plurality of flattened portion 70.

In this application, each of the primary surface sheets 32 is formed by connecting a first sheet portion 80 with a second sheet portion 82 prior to forming on a roll, not shown. For simplicity sake, the resulting primary surface sheet 32 formed by the first sheet portion 80 and the second sheet portion 82 will be defined as being formed in an individual sheet 32, which is an optional manner of making each of the primary surface sheets 32 verses joining on a roll and forming the plurality of serpentined pleats 50 prior to forming individual sheets 32 as is used in this application. The primary surface sheet 32, in this application, is joined along the axis 62. The first portion 82 and the second portion 84 are joined by a welding process. Thus, each of the first sheet portions 80 and the second sheet portion 82 form a mirror image. The first sheet portion 80 has a first side 84, a second side 86, a first end 88 and a second end 90. And, the second sheet portion 82 has a first side 92, a second side 94, a first end 96 and a second end 98. The first sheet 80 has a preestablished thermal deformation characteristic. For example, the thermal deformation characteristic has a preestablished temperature gradient, which resists high temperature deformation and has a high temperature resistance to corrosion. The second sheet portion 82 has a preestablished thermal deformation characteristic which is less than that of the first sheet portion 80. This results in the second sheet portion 82 having a lower resistance to high temperature deformation and a lower high temperature resistance to corrosion than that of the first sheet portion 80. In this application, the first sheet portion 80 is made from a nickel super alloy material and the second sheet portion 82 is made from a 347 stainless steel material. In this application, the first side 84 of the first sheet portion 80 is aligned with the first side 92 of the second sheet portion 82 and the first sheet portion 80 is joined to the second sheet portion 82. For example, in this application, the first sheet portion 80 is continuously welded along the axis 62 with an electron beam welded to the second sheet portion 82. Or as an alternative, the first sheet portion 80 can be laser welded to the second sheet portion 82. As another alternative, the first sheet 80 and the second sheet 82 can be fusion or chemically bonded one to another. After the first sheet portion 80 and the second sheet portion 82 are joined, the plurality of serpentined pleats 50 and the plurality of flattened portion 70 are formed and an individual sheet 32 is formed from the roll stock.

The plurality of recipient bars 34 have a pair of ends 100 and a preestablished length extending between the pair of ends 100. And, the plurality of donor bars 36 have a pair of ends 102 and a preestablished length extending between the pair of ends 102. In this application, the plurality of recipient bars 34 are made from a preestablished material and the plurality of donor bars 36 are made from the same preestablished material. However, it is contemplated that the plurality of donor bars 36 could be made of different material than that of which the plurality of recipient bars 34 are made. Each of the plurality of donor bars 36 and the plurality of recipient bars 34 having a different thermal deformation characteristic. For example, the thermal deformation characteristic of the plurality of donor bars 36 would have a preestablished temperature gradient, which resists high temperature deformation and has a high temperature resistance to corrosion. Whereas the plurality of recipient bars 34 would have a preestablished thermal deformation characteristic which is less than that of the plurality of donor bars 36. This results in the plurality of recipient bars 34 having a lower resistance to high temperature deformation and a lower high temperature resistance to corrosion than that of the plurality of donor bars 36. It is contemplated that in such an alternative, the plurality of donor bars 36 would be made from a nickel super alloy material and the plurality of recipient bars 34 would be made from a 347 stainless steel material. The plurality of recipient bars 34 are positioned near each of the pair of ends 58, on the recipient end flattened surface 78 and have one of the pair of ends 100 generally aligned with one of the pair of sides 60. The plurality of donor bars 36 are positioned near each of the pair of ends 58, on the donor end flattened surface 76 and each of the pair of ends 102 are generally aligned with a corresponding one of each of the pair of sides 60.

Industrial Applicability

In operation, the gas turbine engine 10 is started and brought up to operating speed, temperature etc. The flow of exhaust gas 14 exits the gas turbine engine 10 and enters the recuperator 12 through the donor inlet duct 16. The flow of exhaust gas 14 enters the core 44 and passes through the plurality of donor passages 45. As the flow of exhaust gas 14 enters the donor passages 45 one of the pair of donor guide members 42 directs the flow of exhaust gas 14 evenly though the plurality of serpentined pleats 50. And, the other of the plurality of donor guide members 42 gathers the spent donor exhaust gas 14 and exits the exhaust gas 14 though the donor outlet duct 18 to the atmosphere.

During the flow of exhaust gas 14 though the plurality of serpentined pleats 50 the flow of exhaust gas 14 being it hottest, maximum temperatue, enter the first sheet portion 80 at the second side 86. As the flow of exhaust gas 14 travels across the first sheet portion 80 from the second side 86 to the first side 84 and continues along the second sheet portion 82 from the first side 92 to the second side 94 the temperature of the flow of exhaust gas 14 decreases in temperature to its minimum temperature. During the travel of the flow of exhaust gas 14 the higher heat of the exhaust gas 14 is absorbed near the second side 86 of the first sheet portion 80 and progressively transfers less heat to each of the plurality of sheets 32 as the exhaust gas 14 is reduced in temperature and as the flow of exhaust gas 14 reaches the first side 84 of the first sheet portion 80. Additional heat from the flow of exhaust gas 14 is absorbed in each of the plurality of sheets 32 near the first side 92 of the second sheet portion 82 and progressively absorbs less heat in each of the plurality of sheets 32 as the flow of exhaust gas 14 is reduced in temperature and as the flow of exhaust gas 14 reaches the second side 94 of the second sheet portion 82. Thus, during the operation of the recuperator 12 the first sheet portion 80 having the preestablished temperature gradient which resists high temperature deformation and has a high temperature resistance to corrosion is effectively in contact with the higher temperature of the flow of exhaust gas 14 between the second side 86 and the first side 84 of the first sheet portion 80. And, as the temperature of the flow of exhaust gas 14 is progressively reduced and travels along each of the plurality of sheets 32 between the first side 92 and the second side 94 the lower temperature of the flow of exhaust gas 14 is effectively in contact with the second sheet portion 82 having a lower resistance to high temperature deformation and a lower high temperature resistance to corrosion than that of the first sheet portion 80. Thus, with each of the plurality of sheets 32 having the first portion 80 being made from the first material and the second portion 82 being made from the second material the thermal deformation characteristic of each of the plurality of sheets 32 is greatly improved. With each of the plurality of sheets 32 having the first portion 80 made of the first material having the better resistance to thermal deformation characteristic as compared to the second portion 82 made of the second material each of the plurality of sheets can be made in a cost effective manner which reduces stress and increased longevity of the recuperator 12.

During the flow of the exhaust gas 14, the flow of atmospheric air or recipient fluid 20 enters the gas turbine engine 10. The recipient fluid 20 passes to the compressor section 24 is compressed and flows through the recipient inlet duct 22 into the core 44 of the recuperator 12. The flow of recipient fluid 20 enters the core 44 and passes through the plurality of recipient passages 46. As the flow of recipient fluid 20 enters the recipient passages 46 one of the pair of recipient guide members 40 directs the flow of recipient fluid 20 evenly though the plurality of serpentined pleats 50. Within the plurality of serpentined pleats 50 of the recipient passage 46 heat from the exhaust gas or donor fluid 14 is transferred from the donor side 48D to the recipient side 48R and is absorbed within the recipient fluid 20. As the recipient fluid 20 exits the plurality of serpentined pleats 50 the other of the plurality of recipient guide members 40 gathers the heated recipient fluid 20 and directs the heated recipient fluid 20 to the recipient outlet duct 20 and to the combustor section 28. Thus, with the heat of the exhaust being transferred to the atmospheric intake air the efficiency of the gas turbine engine 10 is increased and results in lower fuel consumption and lower operating cost.

However, as the gas turbine engine 10 cycles between cold start, hot starts, etc. the recuperator 12 goes through a plurality of thermal cycles and thermal stressed conditions. With the plurality of primary surface sheets 32, plurality of donor bars 36 and plurality of recipient bars 34 welded into a cell 44 and the plurality of cells 44 welded into the recuperator 12 stress from the plurality of thermal conditions tends to flex the weld and cause the weld or component parts to fail. With the plurality of primary surface sheets 32, having the first sheet portion 80 made from high temperature deformation and high temperature resistance to corrosion placed near the inlet of the flow of exhaust gas 14, hottest exhaust, less failure of the weld and component parts will occur. And, with the second sheet portion 82 made from the material having lower temperature deformation and resistance to corrosion an economical cell 30, core 44 and recuperator 12 is accomplished while increasing the longevity of the recuperator 12.

Other aspects, objects and advantages will become apparent from a study of the specification, drawings and appended claims.

What is claimed is:

1. A primary surface sheet being adapted for use in a recuperator; said primary surface sheet comprising:

a first sheet portion defining a pair of sides and having a preestablished thermal deformation characteristic, said preestablished thermal deformation characteristic including a resistance to high temperature deformation and a high temperature resistance to corrosion;

a second sheet portion defining a pair of sides and having a preestablished thermal deformation characteristic being less than said resistance to high temperature deformation and said high temperature resistance to corrosion than that of said first sheet portion; and said first sheet portion and said second sheet portion being attached at a respective one of said pair of sides of said first sheet portion and said second sheet portion forming an axis to form said primary surface sheet, said axis being positioned at an angle to said pair of sides.

2. The primary surface sheet of claim 1 wherein said first portion is attached to said second portion by a welding process.

3. The primary surface sheet of claim 1 wherein said primary surface sheet includes a plurality of pleats.

4. The primary surface sheet of claim 3 wherein said plurality of pleats being serpentined.

5. The primary surface sheet of claim 3 wherein each of said plurality of pleats include a respective root and a respective crest.

6. The primary surface sheet of claim 1 wherein said primary surface sheet includes a pair of ends, and positioned along each of said pair of sides and said pair of ends is a plurality of flattened surfaces.

7. A cell being adapted for use with a recuperator; said cell comprising:

a plurality of primary surface sheets being spaced apart a preestablished distance forming a fluid flow path, each of said primary surface sheets including a first sheet portion defining a pair of sides and having a preestablished thermal deformation characteristic, said preestablished thermal deformation characteristic including a resists to high temperature deformation and a high temperature resistance to corrosion and a second sheet portion defining a pair of sides and having a preestablished thermal deformation characteristic being less than said resistance to high temperature deformation and said high temperature resistance to corrosion of said first sheet portion, and said first sheet portion and said second sheet portion being attached at a respective one of said pair of sides of said first sheet portion and said second sheet portion forming an axis to form said primary surface sheet, said axis being positioned at an angle to said pair of sides;

a plurality of bars being interposed said plurality of primary surface sheets; and said plurality of primary surface sheets and said plurality of bars being fixedly attached.

8. The cell of claim 7 wherein each of said plurality of primary surface sheets includes a plurality of pleats.

9. The cell of claim 7 wherein said plurality of bars include at least one of a plurality of recipient bars and a plurality of donor bars.

10. The cell of claim 7 wherein said cell includes a plurality of guiding members interposed said plurality of primary surface sheets.

11. The cell of claim 10 wherein said plurality of guiding members include at least one of a pair of recipient guiding members and a pair of donor guiding members.

12. The cell of claim 7 wherein said plurality of bars define a plurality of donor bars having a preestablished thermal deformation characteristic including a resistance to high temperature deformation and a high temperature resistance to corrosion.

13. The cell of claim 12 wherein said plurality of bars define a plurality of recipient bars having a preestablished thermal deformation characteristic including a resistance to high temperature deformation and a high temperature resistance to corrosion, said preestablished thermal deformation characteristic being less than that of the plurality of donor bars.

* * * * *